US005512720A

United States Patent [19]

Coudert et al.

[11] Patent Number: 5,512,720

[45] Date of Patent: Apr. 30, 1996

[54] AUXILIARY TRIP DEVICE FOR A CIRCUIT BREAKER

[75] Inventors: Patrick Coudert, Eybens; Jean-Pierre Nereau, Seyssinet, both of France

[73] Assignee: Merlin Gerin, France

[21] Appl. No.: 220,016

[22] Filed: Mar. 30, 1994

[30] Foreign Application Priority Data

Apr. 16, 1993 [FR] France ..... 93 04857

[51] Int. Cl.[6] ..... H01H 5/00

[52] U.S. Cl. ..... 200/400; 200/323; 200/318

[58] Field of Search ..... 200/400, 401, 200/43.14, 538, 323, 329, 330, 331, 332.2, 337, 338, 339, 318; 335/167, 172, 174, 175, 176

[56] References Cited

U.S. PATENT DOCUMENTS 2,697,148 12/1954 Slebodnik .
3,293,577 12/1966 Kiesel et al. .
4,061,993 12/1977 Hennemann .
5,294,903 3/1994 Bosch et al. ..... 335/172
5,343,179 8/1994 Pipich et al. ..... 335/167

FOREIGN PATENT DOCUMENTS 1091720 4/1955 France .
2303367 10/1976 France .

*Primary Examiner*—Henry J. Recla
*Assistant Examiner*—David J. Walczak
*Attorney, Agent, or Firm*—Parkhurst, Wendel & Rossi

[57] ABSTRACT

An auxiliary trip device for a circuit breaker which includes an electromechanical actuating device and an energy storage system. The electromechanical actuating device includes a coil housed in a sheath which has a central bore containing a plunger fixed to a push-rod, and a fixed core spaced apart from the plunger, via a first spring. The push-rod is slidable within the bore to actuate a latch device of the energy storage system, which in turn releases a blade which is cooperable with a trip bar of the circuit breaker on which the auxiliary trip device is placed. The blade is biased by a second spring which releases and stores energy greater than released and stored energy of the first spring.

5 Claims, 4 Drawing Sheets

AUXILIARY TRIP DEVICE FOR A CIRCUIT BREAKER

BACKGROUND OF THE INVENTION

The present invention relates in a general manner to auxiliary trip devices designed to be associated with circuit breakers, notably molded case circuit breakers.

A conventional molded case circuit breaker comprises in a general manner, inside a molded case, a circuit breaker operating mechanism, a trip bar movable in such a way as to bring about breaking of the latching of the circuit breaker operating mechanism and at least one main trip device designed to command movement of the trip bar. If the circuit breaker is multipole, a certain number of main trip devices may be provided, this number being equal to the number of poles of the circuit breaker. In this case, if any one of the main trip devices of the circuit breaker detects an electrical condition which is greater than a preset threshold, for example if it detects a current intensity flowing in the corresponding pole greater than a preset value, this main trip device operates to command movement of the trip bar, this movement of the trip bar causing breaking of the circuit breaker operating mechanism latching, and this circuit breaker operating mechanism thus causing simultaneous interruption of the different current channels which correspond to the different poles of the multipole circuit breaker.

In a conventional molded case circuit breaker of this kind, whether single-pole or multipole, it may be desirable to associate an auxiliary trip device to the circuit breaker, this trip device being designed to also be able to bring about breaking of the circuit breaker operating mechanism latching, independently from operation of the main trip device or devices included in the circuit breaker. For example, it may be desirable to associate or to combine with the circuit breaker an auxiliary trip device of a first type which performs continuous detection of the presence or absence of a voltage at circuit breaker level and which is designed to make the circuit breaker trip when this voltage falls to zero or falls below a preset threshold. Such an auxiliary trip device of this first type, which is a conventional auxiliary trip device, is commonly called "auxiliary trip device of the undervoltage release type".

An auxiliary trip device of a second type can also be used which is designed to make the circuit breaker trip when an electrical current greater than a preset level flows inside the auxiliary trip device. Such an auxiliary trip device of the second type, which is a conventional auxiliary trip device, is commonly called "auxiliary trip device of the shunt release type".

Consequently, circuit breakers including or receiving auxiliary trip devices which may be either auxiliary trip devices of the undervoltage release type or auxiliary trip devices of the shunt release type have already been achieved or proposed. It has also been proposed to design an auxiliary trip device able to constitute either an auxiliary trip device of the undervoltage release type or an auxiliary trip device of the shunt release type. An auxiliary trip device of this kind generally comprises a certain number of parts which are common to both types of auxiliary trip devices to be constituted. Other parts of the auxiliary trip device are on the other hand specific to the auxiliary trip device of the undervoltage release type and other different parts are specific to the auxiliary trip device of the shunt release type. Moreover, certain parts which are common to both these types of auxiliary trip device have to be mounted differently for the two types of auxiliary trip devices. The fact that a large number of parts are different between these two types of auxiliary trip devices constitutes a drawback since this leads to a relatively high manufacturing cost and an assembly cost which is also relatively high.

SUMMARY OF THE INVENTION

One object of the present invention is to propose an auxiliary trip device for a molded case circuit breaker, this auxiliary trip device being able to constitute either an auxiliary trip device of the undervoltage release type or an auxiliary trip device of the shunt release type, whereas almost all of the parts which constitute such an auxiliary trip device are identical for both types of auxiliary trip devices which can thus be constituted.

Another object of the present invention is to propose an auxiliary trip device wherein the tripping threshold of the auxiliary trip device is both precise and adjustable, this threshold being able to be different when the auxiliary trip device is of the first type or of the second type and this threshold adjustment being able to be performed independently when the auxiliary trip device is of the first type or of the second type.

The invention therefore relates more specifically to an auxiliary trip device for a molded case circuit breaker, said circuit breaker comprising: a circuit breaker operating mechanism; a trip bar movable in such a way as to cause breaking of the latching of the circuit breaker operating mechanism; and at least one main trip device designed to command movement of the trip bar, said auxiliary trip device comprising, in a trip device case: an electromechanical actuating device including a coil surrounding a sheath, in the sheath, a fixed core, a plunger defining an air-gap with the fixed core, a push-rod connected to the plunger and a first spring continuously pushing the push-rod in the direction increasing the size of the air-gap; and an energy storage system including a blade designed to command movement of said trip bar, a second spring storing energy to actuate the blade and a latch latched to the blade and movable to release its latching to the blade.

According to an essential feature of the present invention, said second spring stores and releases, during its movements in the course of operation of said auxiliary trip device, an energy greater than the energy stored and released by said first spring during its movements in the course of operation of said electromechanical actuating device; and an actuating part of the push-rod can push on an actuating part of the latch in such a way that movement of the latch in the direction of releasing of its latching to the blade is brought about by movement of the push-rod in a specific direction, a clearance being provided between said actuating part of the push-rod and said actuating part of the latch when the push-rod is not moved in said specific direction.

According to a particular embodiment of the invention, the push-rod is fixed to the plunger and extends slidingly through the fixed core; the first spring surrounds the push-rod and exerts a thrust at the level of its two ends respectively on the fixed core and on the plunger, in the direction of their separation from one another; the external diameter of the fixed core is greater than the external diameter of the plunger; and the sheath has a central hole which passes longitudinally through said sheath and which comprises a first bore opening out onto a first end, a second bore of appreciably the same diameter and opening out onto a second opposite end, and a middle part of a smaller diameter than that of said first and second bores; which results in the assembly formed by the fixed core, plunger, push-rod and first spring being able to be mounted inside the hole of the sheath in either of the following two manners: either by housing the fixed core fixedly in the first bore so as to constitute an auxiliary trip device of the undervoltage release type or by housing the fixed core fixedly in the second bore so as to constitute an auxiliary trip device of the shunt release type.

BRIEF DESCRIPTION OF THE DRAWINGS

These objects, advantages and features will become more clearly apparent from the following description of an illustrative embodiment of the present invention, given as a non-restrictive example only and represented in the accompanying drawings in which.

DETAILED DESCRIPTION OF THE PREFERRED EMBODIMENT

Figure 1:
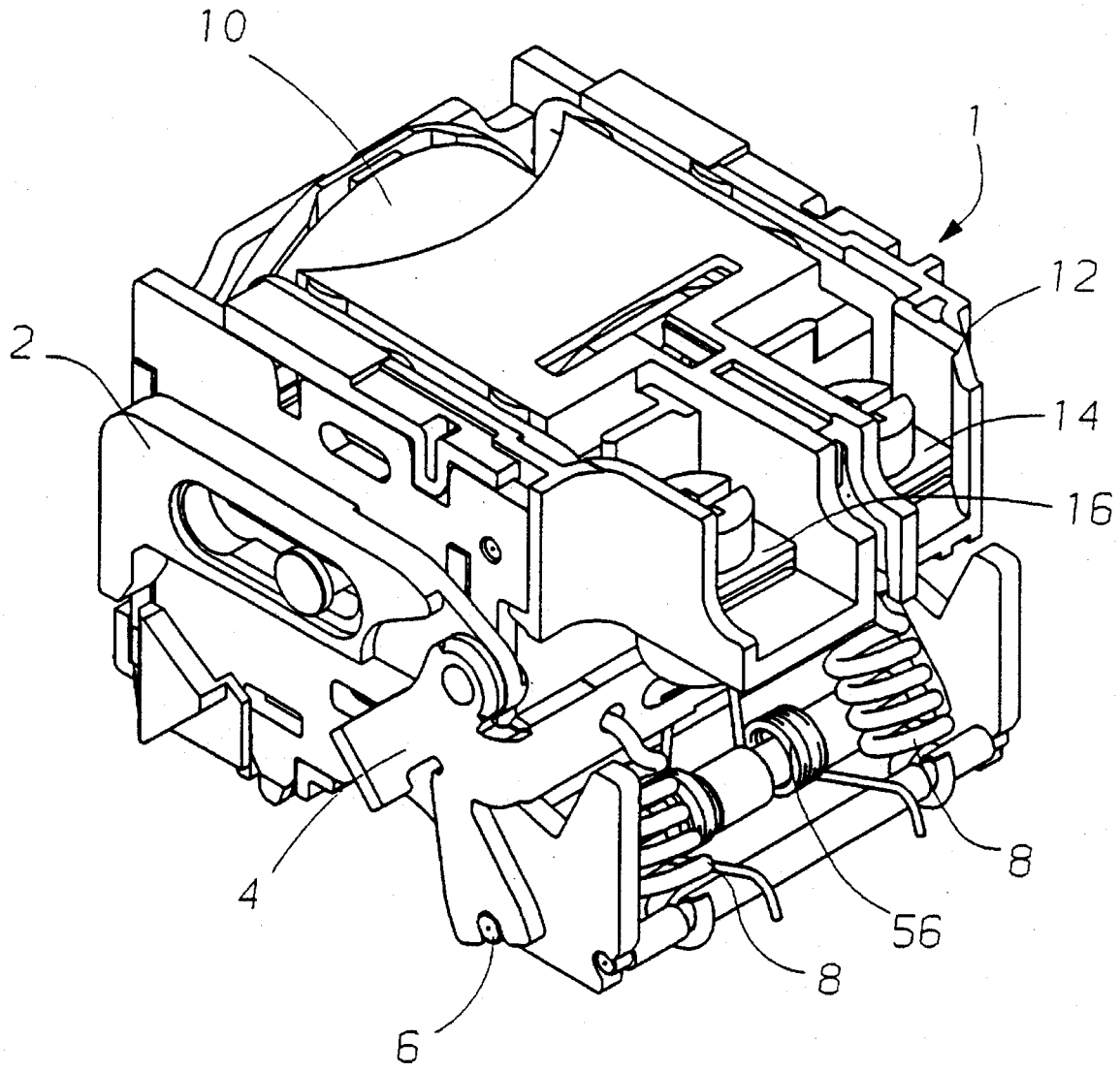
FIG. 1 is a general perspective view of an auxiliary trip device according to the present invention.

In FIG. 1, an auxiliary trip device according to the present invention is indicated in a general manner by the reference 1.

The auxiliary trip device 1 according to the invention is designed to be adjoined to or to be housed in a conventional molded case circuit breaker (not represented). The auxiliary trip device 1 comprises in a general manner a trip unit case 2 which is designed to support in fixed or movable manner most of the parts which make up the unit. An energy storage system is formed in a general manner by a blade 4 which is pivotally mounted on the case 2 at the level of two articulations 6 located on each side of the case 2 and a spring 8 which is designed to store energy for actuation of the blade. In the example represented in FIG. 1, two springs 8 are in fact provided which are mounted in parallel and act jointly.

The auxiliary trip device 1 comprises an electromechanical actuating device which includes a coil 10 which surrounds other parts of the device (not represented in FIG. 1 and which will be described in greater detail further on in the text). The auxiliary trip device also comprises a terminal block 12 supporting two electrical terminals 14, 16 which are electrically connected to the coil 10 and are designed to be connected to external electrical wires (not represented). Most of the internal parts of the auxiliary trip device 1 are not visible in FIG. 1 and will be described hereinafter.

Figure 2:
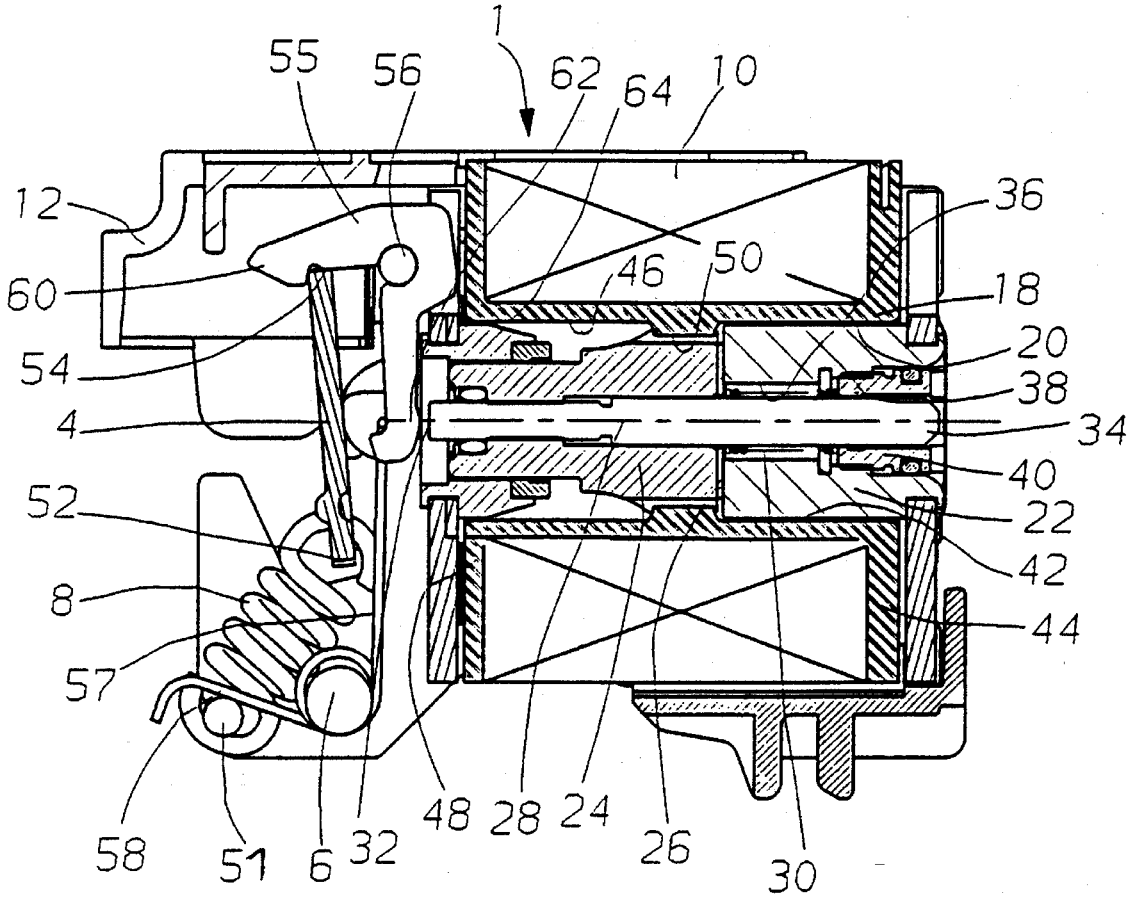
FIG. 2 is a longitudinal sectional view of the auxiliary trip device of FIG. 1, when the latter is mounted so as to constitute an auxiliary trip device of the undervoltage release type.

FIG. 2 represents a longitudinal cross-section of the auxiliary trip device of FIG. 1 when the latter is mounted in a particular manner so as to constitute an auxiliary trip device of the undervoltage type. In FIG. 2, the auxiliary trip device 1 is represented in greater detail. The electromechanical actuating device essentially includes the coil 10 which surrounds a sheath 18 comprising a central hole 20 which passes completely through it longitudinally, and in said sheath there are arranged a fixed core 22, a plunger 24 defining with the fixed core 22 an air-gap 26, a push-rod 28 rigidly secured to the plunger 24 and a first spring 30. The push-rod 28 is in the form of an elongated rod which is threaded through a central hole of the plunger 24 and which is fixed to the plunger 24 by screwing. A first end 32 of the push-rod 28 protrudes slightly out from the plunger 24 and the other opposite end 34 of the push-rod 28 is relatively far from the plunger 24, i.e. a significant part of the push-rod 28 extends (to the right in FIG. 2) over a long distance outside the plunger 24 whereas opposite end 32 extends over a short distance outside the plunger 24 At the level of the part of the push-rod 28 which extends over a long distance outside the plunger 24 on the side where the end 34 is located, the first spring 30 is disposed in such a way as to surround the push-rod 28 whereas the plunger 24 is disposed around the same part of the push-rod 28.

The fixed core 22 comprises a longitudinal hole which passes through said core in such a way as to let the push-rod 28 pass through and in such a way as to constitute, in a part of the fixed core 22, a housing 36 for the first spring 30. The fixed core 22 comprises in addition at the level of its central hole a threaded part 38 in which a stop part 40 is fixed which may be adjusted axially by screwing said part 40 more or less into the threaded part 38.

The first spring 30 bears on one side against an end face of the plunger 24, said face also forming the air-gap 26, and bears on the other side against an end face of the stop part 40. This has the result that the compression force of the first spring 30 tends to move the plunger 24 away from the fixed core 22 and to make the air-gap 26 take a maximum dimension.

The central hole 20 of the sheath 18 comprises a first bore 42 which opens out onto a first end 44 of the sheath, a second bore 46 which opens out at the level of a second opposite end 48 of the sheath and a middle part 50 which has a smaller diameter than the diameter of the first bore 46, the diameters of the bores 42 and 46 being preferably equal.

As has already been described in a general manner with reference to FIG. 1, the assembly details of the energy storage system can be seen in FIG. 2. This energy storage system comprises the blade 4 which is pivotally mounted around the spindle 6 and the second spring 8 which stores energy in order to actuate the blade 4 at high speed. The second spring 8 has an end fixed to a fixed securing part 51 and its other end is fixed to a securing part 52 of the blade 4. The blade 4 comprises a latching end 54 which is located away from the articulation 6. This energy storage system comprises in addition the latch 55 which is pivotally mounted around the spindle 56 and which is permanently biased (counterclockwise in FIG. 2) by means of a spring 57 which is wound around the articulation spindle 6 and which is secured to the case of the unit by means of one of the branches 58 of the spring which presses permanently against a part of the securing part 51. The latch 55 comprises a latching part 60 which cooperates with the latching part 54 of the blade 4, when said blade 4 is in the charged position for which it is moved by pivoting (clockwise in FIG. 2) in the direction which stretches the second spring 8. The blade 4 is designed to command movement of a trip bar (not represented) which is conventionally included in a conventional circuit breaker and which is itself designed to bring about, in conventional manner, breaking of the latch of a circuit breaker operating mechanism itself included in a conventional circuit breaker.

The latch 55 is, in the charged position, latched to the blade 4 and is movable (by clockwise pivoting in FIG. 2)

against the spring 57 in order to release its latching to the blade 4 so as to enable the blade 4, due to the relaxation of the second spring 8, to move at high speed by pivoting so as to cause movement of the trip bar (not represented) of the circuit breaker (not represented).

Movement of the latch 55 in the direction which causes its unlatching from the blade 4 is obtained by an appropriate movement of the push-rod 28. In FIG. 2, it can be seen that the end 32 of the push-rod 28 constitutes an actuating part of the push-rod 28 located facing and a short distance from an actuating part 62 of the latch 55. When the auxiliary trip device 1 is charged, i.e. when it is in the position represented in FIG. 2, the latch 55 is latched to the blade 4 and the latch 55 is in a (counterclockwise) pivoted position so that its actuating part 62 is Located a small distance from the actuating part 32 of the push-rod 28. This small distance is hereinafter called "clearance". Naturally, in this charged position, the push-rod 28 is in a rest position as represented in FIG. 2, and this rest position in fact corresponds to a position of the push-rod 28 in which it is completely biased (to the right) due to the fact that the coil 10 is constantly supplied with electrical current with the consequence that the plunger 24 is attracted against the fixed core 22 (i.e. that the air-gap 26 is minimum). If at any time the current flowing in the coil 10 drops below a preset threshold, i.e. if the voltage at the terminals of said coil 10 falls to zero or falls below a preset threshold, the compression force of the first spring 30 becomes greater than the attractive force of the plunger 24 towards the fixed core 22, and the push-rod 28 then moves to the left in FIG. 2, i.e. in the direction of the actuating part 62 of the latch 55, and this movement of the push-rod 28 causes pivoting (clockwise in FIG. 2) of the latch 55 which then unlatches from the blade 4, and this blade 4 is then released and moves at high speed due to the action of the second spring 8.

An essential feature of the invention resides in the fact that the second spring 8 can store and release, when performing its movements in the course of operation of the auxiliary trip device 1, a mechanical energy greater than the mechanical energy which can be stored and released by the first spring 30 when performing its movements in the course of operation of the electromagnetic actuating device of the same auxiliary trip device 1.

Another feature of the present invention resides in the fact that a "clearance" is provided between the actuating part 32 of the push-rod 28 and the corresponding actuating part 62 of the latch 55, when the latch is latched to the blade 4 and when the push-rod 28 is normally biased due to normal excitation of the coil 10.

It can be seen that the auxiliary trip device of FIG. 2, which constitutes a trip device of the undervoltage tripping type, can operate correctly whereas the coil 10 is supplied with electrical current with a very low electrical power (for example low voltage and/or low current). The coil 10 in fact creates an electromechanical force which is just sufficient to overcome the compression force of the first spring 30. This first spring 30 may have a very weak compression force. The compression force of the spring 30 must however be sufficient to be able to actuate the latch 55 so that said latch releases the blade 4. However, as a clearance is provided between the first end 32 of the push-rod 28 and the corresponding actuating part 62 of the latch 55, when the voltage at the terminals of the coil 10 decreases, even very slowly, until it is lower than the preset threshold, the first spring 30 suddenly causes a beginning of movement of said push-rod 28 in the direction increasing the air-gap 26, this beginning of movement of the push-rod 28 taking place completely independently from the energy storage system formed by the latch 55, blade 4 and second spring 8 throughout the time the push-rod 28 moves in the direction of the latch 55 so as to take up the "clearance" referred to above.

This results in it being possible under these conditions to design a mechanical assembly formed essentially by the fixed core 22, plunger 24, push-rod 28 and first spring 30, which is able to operate in a precise, sensitive (i.e. with very limited friction forces) and reliable manner, so as to be able to constitute the precise and reliable preset threshold for which the auxiliary trip device brings about the tripping action.

Moreover, such a feature of precision and reliability of the auxiliary trip device tripping threshold can be obtained for an extremely low electrical power consumed in the coil 10, for example a few milliwatts.

Figure 4:
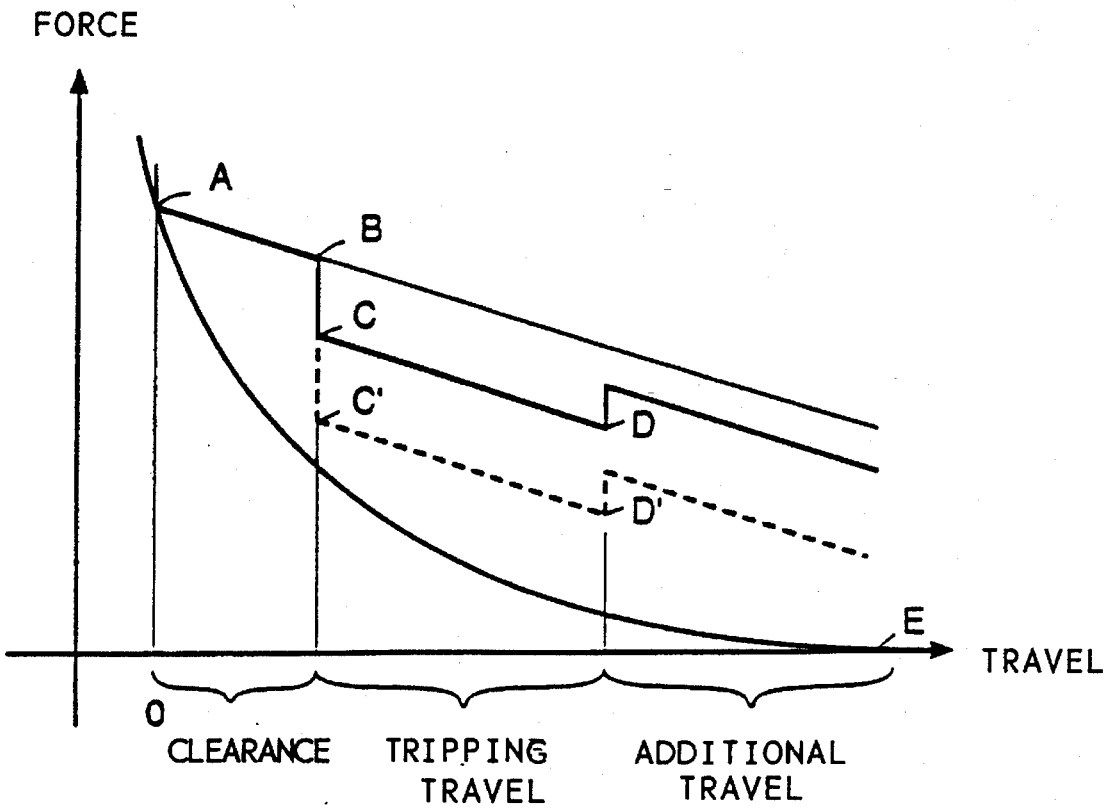
FIG. 4 is a diagram representing the variations of the different forces involved in the auxiliary trip device of FIG. 2, in the course of operation of the latter.

FIG. 4 represents a diagram presenting the variations of the attractive force of the plunger 24 towards the fixed core 22 and the variations of the thrust force of the push-rod 28 against the actuating part 62 of the latch 55, depending on the position taken by the push-rod 28. On the x-axis, the position 0 corresponds to the position of the push-rod 28 when the plunger 24 is fully attracted towards the fixed core 22. It can be seen that so long as the voltage at the terminals of the coil 10 is greater than a preset threshold, the attractive force of the plunger towards the fixed core for the minimum air-gap is greater than the thrust force of the first spring 30. The point A of the graph corresponds to the voltage threshold for which the attractive force is equal to the thrust force of the first spring 30.

If the voltage at the terminals of the coil 10 decreases so as to fall below the threshold value corresponding to the point A, the push-rod 28 moves in the direction of the latch 55 at high speed. The thrust force of the push-rod 28 follows the linear segment A-B during the time the clearance existing between the push-rod 28 and latch 55 is taken up, then the push-rod 28 pushes the latch 55 and, due to the friction forces and various mechanical resistances in the mechanism of the latch 55 and of the blade 4 which oppose movement of the latch 55, the actual thrust force of the push-rod 28 is reduced by these resistance forces, in such a way that the actual thrust force of the push-rod 28 follows the segments B-C then C-D on the graph. However, at the same time, the attractive force of the plunger 24 towards the fixed core 22 follows the curve A-E which decreases very quickly and this curve A-E remains at all times below the paths A-B-C-D.

This has the result that, when the push-rod 28 has begun to move in the direction of the latch 55, due to the fact that the voltage applied to the coil 10 has become equal to or slightly less than the preset threshold voltage, the movement can no longer be interrupted until the push-rod 28 actuates the latch 55 completely, whatever the mechanical resistance forces which are more or less random and variable and which involve the whole of the tripping mechanism formed by the latch 55, blade 4 and second spring 8. On the graph, the variation of force measured on the y-axis corresponding to the segment A-B corresponds to the sum of the random mechanical forces which may oppose actuation of the latch 55. To represent the fact that these mechanical forces are random, points C'-D' have been represented different from the points C-D in order to show that these mechanical forces resisting movement of the latch 55 can vary to a great extent without influencing the fact that when the push-rod 28 starts to move to actuate the latch 55, said push-rod 28 goes to the end of its movement travel in order to actuate the latch 55 completely.

Figure 3:
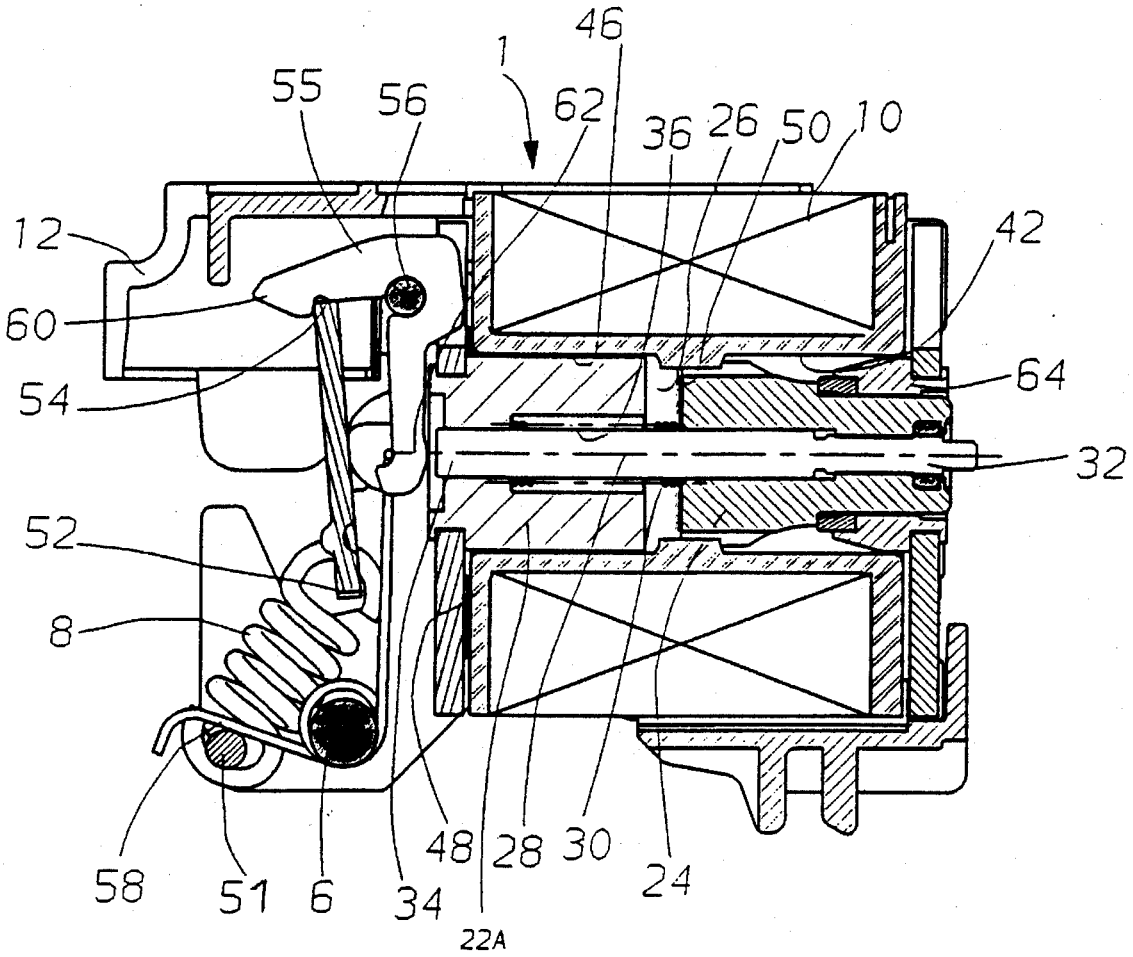
FIG. 3 is a longitudinal sectional view of the auxiliary trip device of FIG. 1, when the latter is mounted so as to constitute an auxiliary trip device of the shunt release type.

In FIG. 3, the auxiliary trip device 1 which has already been described with reference to FIGS. 1 and 2 can be seen but assembled differently so as to form an auxiliary trip device of the shunt release type. It can be seen that an auxiliary trip device of the shunt release type can thus be constituted using practically the same parts as those of the auxiliary trip device of the undervoltage release type represented in FIG. 2.

In FIG. 3, the same reference numbers have been used for the same parts as those used in FIG. 2, even when these same parts are not assembled in the same way or in the same direction in these figures.

The differences between the auxiliary trip device of FIG. 3 and the auxiliary trip device of FIG. 2 are as follows:

the fixed core 22 is mounted in the first bore 42 for the auxiliary trip device of FIG. 2 whereas the fixed core 22A is mounted in the second bore 46 for the auxiliary trip device of FIG. 3; and the fixed core 22A of the auxiliary trip device of FIG. 3 can be designed in exactly the Same way as the fixed core 22 of the auxiliary trip device of FIG. 2 but it can also be designed in a slightly different way, as is effectively represented in FIG. 3, this difference consisting in the fixed core 22 being able to include the adjusting part 40 used to adjust the compression force Of the first spring 30 whereas the fixed core 22A does not need to include such a part 40.

The assembly formed by the fixed core 22A, plunger 24, push-rod 28 and first spring 30 can be mounted inside the hole of the sheath 18 in either of the following two manners:

either by fixedly housing the fixed core 22 or 22A in the first bore 42 so as to constitute an auxiliary trip device of the undervoltage release type (see FIG. 2), or by fixedly housing the fixed core 22 or 22A in the second bore 46 so as to constitute an auxiliary trip device of the shunt release type (see FIG. 3).

The auxiliary trip device 1 of the shunt release type as represented in FIG. 3 operates in the "opposite" way from the trip device of FIG. 2 in so far as the auxiliary trip device of FIG. 3 trips, i.e. unlocks the latch 55, when an electrical current flowing through the coil 10 exceeds a preset threshold.

It can be seen that no means of adjusting the preset tripping threshold is provided in the auxiliary trip device of the shunt release type represented in FIG. 3, although this could be advantageously envisaged by those specialized in the art, since in general such a auxiliary trip device of the shunt release type does not require tripping for a very precise preset threshold.

The invention is not limited to the embodiment described with reference to FIGS. 2 and 3. Numerous modifications or numerous improvements can be made thereto. Thus, the device can be improved by providing a bearing 64 (see both FIG. 2 and FIG. 3) which surrounds the plunger 24 and which is housed in the bore 42 or 46 of the sheath 18. This part 64 acts as support and guide for the plunger 24 in the course of the longitudinal movement thereof. The plunger 24 must in fact have an external diameter smaller than the internal diameter of the narrow part 50 in order to be able to be fitted, and it can therefore not be directly guided by the bore 42 or 46.

We claim:

1. An auxiliary trip device for a circuit breaker having a trip bar, comprising:

an electromechanical actuating device including a coil provided in a sheath having a bore therein, a fixed core and a movable plunger being provided in said bore, the plunger and the fixed core being axially spaced apart from each other to form an air-gap therebetween, a first spring for biasing said plunger away from said fixed core, and a push-rod connected to said plunger and extending therefrom and through said fixed core, said plunger having an actuating end;

an energy storage system including a blade for actuating the trip bar of the circuit breaker, a latch device having an actuating part and being adapted to lock the blade to prevent movement thereof and to release the blade to allow movement thereof, and a second spring for biasing the blade against the latch device, said second spring storing and releasing an amount of energy during movements of the blade which is greater than an amount energy stored and released by said first spring during movements of the plunger with respect to the fixed core, wherein said actuating end of the push-rod is spaced apart from the actuating part of the latch device, and said push-rod is axially slidable with said plunger such that said actuating end contacts the actuating part to release the blade.

2. The auxiliary trip device of claim 1, wherein said push-rod is fixed to the plunger and is slidable within said fixed core, and said first spring surrounds the push-rod and abuts the fixed core and the plunger.

3. The auxiliary trip device of claim 2, wherein an external diameter of the fixed core is greater than an external diameter of the plunger, and the bore of the sheath includes first and second opposite open end sections and a middle section having a diameter smaller than a diameter of the first and second open end sections.

4. The auxiliary trip device of claim 3, wherein said first open end section faces the actuating part of the latch device, said plunger is provided in said first open end section, and said fixed core is provided in said second open end section.

5. The auxiliary trip device of claim 3, wherein said first open end section faces the actuating part of the latch device, said fixed core is provided in said first open end section, and said plunger is provided in said second open end section.

* * * * *